US006439141B2

(12) United States Patent
Morgante et al.

(10) Patent No.: US 6,439,141 B2
(45) **Date of Patent: *Aug. 27, 2002**

(54) INDEPENDENT SINGLE END SERVO SCROLL PATTERN ATTACHMENT FOR TUFTING MACHINE AND COMPUTERIZED DESIGN SYSTEM

(75) Inventors: Michael R. Morgante, East Aurora, NY (US); Mike Bishop, Signal Mountain, TN (US); Randall E. Stanfield, Soddy-Daisy, TN (US); Eric J. Vaughen, Chattanooga, TN (US); Richard Prichard, Hixson, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/882,632

(22) Filed: Jun. 14, 2001

Related U.S. Application Data

(60) Division of application No. 09/467,432, filed on Dec. 20, 1999, now Pat. No. 6,283,053, which is a continuation-in-part of application No. 08/980,045, filed on Nov. 26, 1997, now Pat. No. 6,244,203.

(60) Provisional application No. 60/031,954, filed on Nov. 27, 1996.

(51) Int. Cl.[7] ..... D05C 15/18

(52) U.S. Cl. ..... 112/80.73; 112/475.23; 700/138

(58) Field of Search ..... 112/80.73, 80.23, 112/80.01, 410, 475.23; 700/138, 136, 137

(56) References Cited

U.S. PATENT DOCUMENTS

| | | | | |
|---|---|---|---|---|
| 2,884,881 A | * | 5/1959 | Oberholtzer | 112/80.73 |
| 5,544,064 A | * | 8/1996 | Padgett, III | 112/410 |
| 5,544,605 A | * | 8/1996 | Frost | 112/475.23 |
| 6,283,053 B1 | * | 9/2001 | Morgante et al. | 112/80.73 |

* cited by examiner

*Primary Examiner*—Peter Nerbun
(74) *Attorney, Agent, or Firm*—Douglas T. Johnson

(57) ABSTRACT

The present invention provides a single end scroll-type yarn feed attachment for tufting machines characterized by independent servo-motor control of yarn feed rolls while eliminating tube banks typical of tufting machine feed attachments to produce new tufted carpet designs.

21 Claims, 7 Drawing Sheets

INDEPENDENT SINGLE END SERVO SCROLL PATTERN ATTACHMENT FOR TUFTING MACHINE AND COMPUTERIZED DESIGN SYSTEM

This application is a divisional of U.S. patent application Ser. No. 09/467,432 filed Dec. 20, 1999, U.S. Pat. No. 6,283,053 which is a continuation-in-part of U.S. Ser. No. 08/980,045 filed Nov. 26, 1997 U.S. Pat. No. 6,244,203 which claims priority from U.S. Provisional Application Ser. No. 60/031,954 filed Nov. 27, 1996 entitled "Independent Single End Servo Scroll Pattern Attachment for Tufting Machine And Computerized Design System" which is incorporated by reference.

BACKGROUND OF THE INVENTION

This invention relates to a yarn feed mechanism for a tufting machine and more particularly to a scroll-type pattern controlled yarn feed wherein each yarn may be wound on a separate yarn feed roll, and each yarn feed roll is driven by an independently controlled servo motor. A computerized design system is also provided because of the complexities of working with the large numbers of individually controllable design parameters available to the new yarn feed mechanism.

Pattern control yarn feed mechanisms for multiple needle tufting machines are well known in the art and may be generally characterized as either roll-type or scroll-type pattern attachments. Roll type attachments are typified by J. L. Card, U.S. Pat. No. 2,966,866 which disclosed a bank of four pairs of yarn feed rolls, each of which is selectively driven at a high speed or a low speed by the pattern control mechanism. All of the yarn feed rolls extend transversely the entire width of the tufting machine and are journaled at both ends. There are many limitations on roll-type pattern devices. Perhaps the most significant limitations are:

(1) as a practical matter, there is not room on a tufting machine for more than about eight pairs of yarn feed rolls;

(2) the yarn feed rolls can be driven at only one of two, or possibly three speeds, when the usual construction utilizing clutches is used—a wider selection of speeds is possible when using direct servo motor control, but powerful motors and high gear ratios are required and the shear mass involved makes quick stitch by stitch adjustments difficult; and (3) the threading and unthreading of the respective yarn feed rolls is very time consuming as yarns must be fed between the yarn feed rolls and cannot simply be slipped over the end of the rolls, although the split roll configuration of Watkins, U.S. Pat. No. 4,864,946 addresses this last problem.

The pattern control yarn feed rolls referred to as scroll-type pattern attachments are disclosed in J. L. Card, U.S. Pat. No. 2,862,465, are shown projecting transversely to the row of needles, although subsequent designs have been developed with the yarn feed rolls parallel to the row of needles as in Hammel, U.S. Pat. No. 3,847,098. Typical of scroll type attachments is the use of a tube bank to guide yarns from the yarn feed rolls on which they are threaded to the appropriate needle. In this fashion yarn feed rolls need not extend transversely across the entire width of the tufting machine and it is physically possible to mount many more yarn feed rolls across the machine. Typically, scroll pattern attachments have between 36 and 120 sets of rolls, and by use of electrically operated clutches each set of rolls can select from two, or possibly three, different speeds for each stitch.

The use of yarn feed tubes introduces additional complexity and expense in the manufacture of the tufting machine; however, the greater problem is posed by the differing distances that yarns must travel through yarn feed tubes to their respective needles. Yarns passing through relatively longer tubes to relatively more distant needles suffer increased drag resistance and are not as responsive to changes in the yarn feed rates as yarns passing through relatively shorter tubes. Accordingly, in manufacturing tube banks, compromises have to be made between minimizing overall yarn drag by using the shortest tubes possible, and minimizing yarn feed differentials by utilizing the longest tube required for any single yarn for every yarn. Tube banks, however well designed, introduce significant additional cost in the manufacture of scroll-type pattern attachments.

One solution to the tube bank problems, which also provides the ability to tuft full width patterns is the full repeat scroll invention of Bradsley, U.S. Pat. No. 5,182,997, which utilizes rocker bars to press yarns against or remove yarns from contact with yarn feed rolls that are moving at predetermined speeds. Yarns can be engaged with feed rolls moving at one of two preselected speeds, and while transitioning between rolls, yarns are briefly left disengaged, causing those yarns to be slightly underfed for the next stitch.

Another significant limitation of scroll-type pattern attachments is that each pair of yarn feed rolls is mounted on the same set of drive shafts so that for each stitch, yarns can only be driven at a speed corresponding to one of those shafts depending upon which electromagnetic clutch is activated. Accordingly, it has not proven possible to provide more than two, or possibly three, stitch heights for any given stitch of a needle bar.

As the use of servo motors to power yarn feed pattern devices has evolved, it has become well known that it is desirable to use many different stitch lengths in a single pattern. Prior to the use of servo motors, yarn feed pattern devices were powered by chains or other mechanical linkage with the main drive shaft and only two or three stitch heights, in predetermined ratios to the revolutions of the main drive shaft, could be utilized in an entire pattern. With the advent of servo motors, the drive shafts of yarn feed pattern devices may be driven at almost any selected speed for a particular stitch.

Thus a servo motor driven pattern device might run a high speed drive shaft to feed yarn at 0.9 inches per stitch if the needle bar does not shift, 1.0 inches if the needle bar shifts one gauge unit, and 1.1 inches if the needle bar shifts two gauge units. Other slight variations in yarn feed amounts are also desirable, for instance, when a yarn has been sewing low stitches and it is next to sew a high stitch, the yarn needs to be slightly overfed so that the high stitch will reach the full height of subsequent high stitches. Similarly, when a yarn has been sewing high stitches and it is next to sew a low stitch, the yarn needs to be slightly underfed so that the low stitch will be as low as the subsequent low stitches. Therefore, there is a need to provide a pattern control yarn feed device capable of producing scroll-type patterns and of feeding the yarns from each yarn feed roll at an individualized rate.

Commonly assigned copending application Ser. No. 08/980,045, U.S. Pat. No. 6,244,203 addressed many of these concerns; however, even that servo scroll pattern attachment did not allow each end of yarn across the entire width of a full size tufting machine to be independently controlled. By providing each end of yarn with an independently driven yarn feed roll, the use of the tube bank can be eliminated, and patterns can be created that do not repeat across the entire width of a broadloom tufting machine.

SUMMARY OF THE INVENTION

It is therefore an object of this invention to provide in a multiple needle tufting machine a pattern controlled yarn feed mechanism incorporating a plurality of individually driven yarn feed rolls across the tufting machine.

The yarn feed mechanism made in accordance with this invention includes a plurality of yarn feed rolls, each being directly driven by a servo motor. About twenty yarn feed rolls with attached servo motors, are mounted upon a plurality of arched mounting arms which are attached to the tufting machine. Each yarn feed roll is driven at the speed dictated by its corresponding servo motor and each servo motor can be individually controlled.

It is a further object of this invention to provide a pattern controlled yarn feed mechanism which does not rely upon electromagnetic clutches, but instead uses only servo motors.

It is another object of this invention to eliminate the need for a tube bank in a scroll type pattern attachment, which further minimizes the differences in yarn feed rates to individual needles.

It is another object of this invention to provide a yarn feed mechanism that operates at high speeds, with great accuracy, in constant engagement with the yarns.

DETAILED DESCRIPTION OF THE INVENTION

Figure 1A:
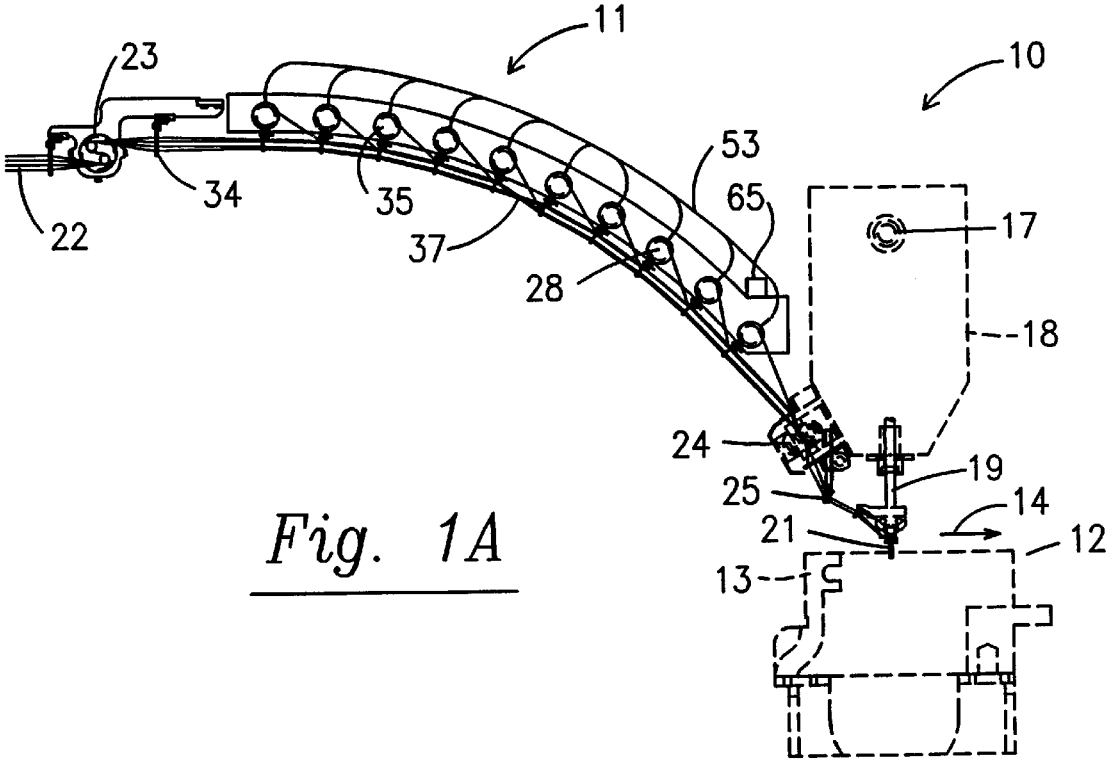
FIG. 1A is a side elevation view of the multiple needle tufting machine incorporating the pattern control yarn feed mechanism made in accordance with the invention.

Referring to the drawings in more detail, FIG. 1A discloses a multiple needle tufting machine 10 upon the front of which is mounted a pattern control yarn feed attachment 11 in accordance with this invention. It will be understood that it is possible to mount pattern control yarn feed attachments 11 on both sides of a tufting machine 10 when desired. The machine 10 includes a housing 12 and a bed frame 13 upon which is mounted a needle plate, not shown, for supporting a base fabric adapted to be moved through the machine 10 from front to rear in the direction of the arrow 14 by front and rear fabric rollers. The bed frame 13 is in turn mounted on the base 15 of the tufting machine 10.

Figure 6:
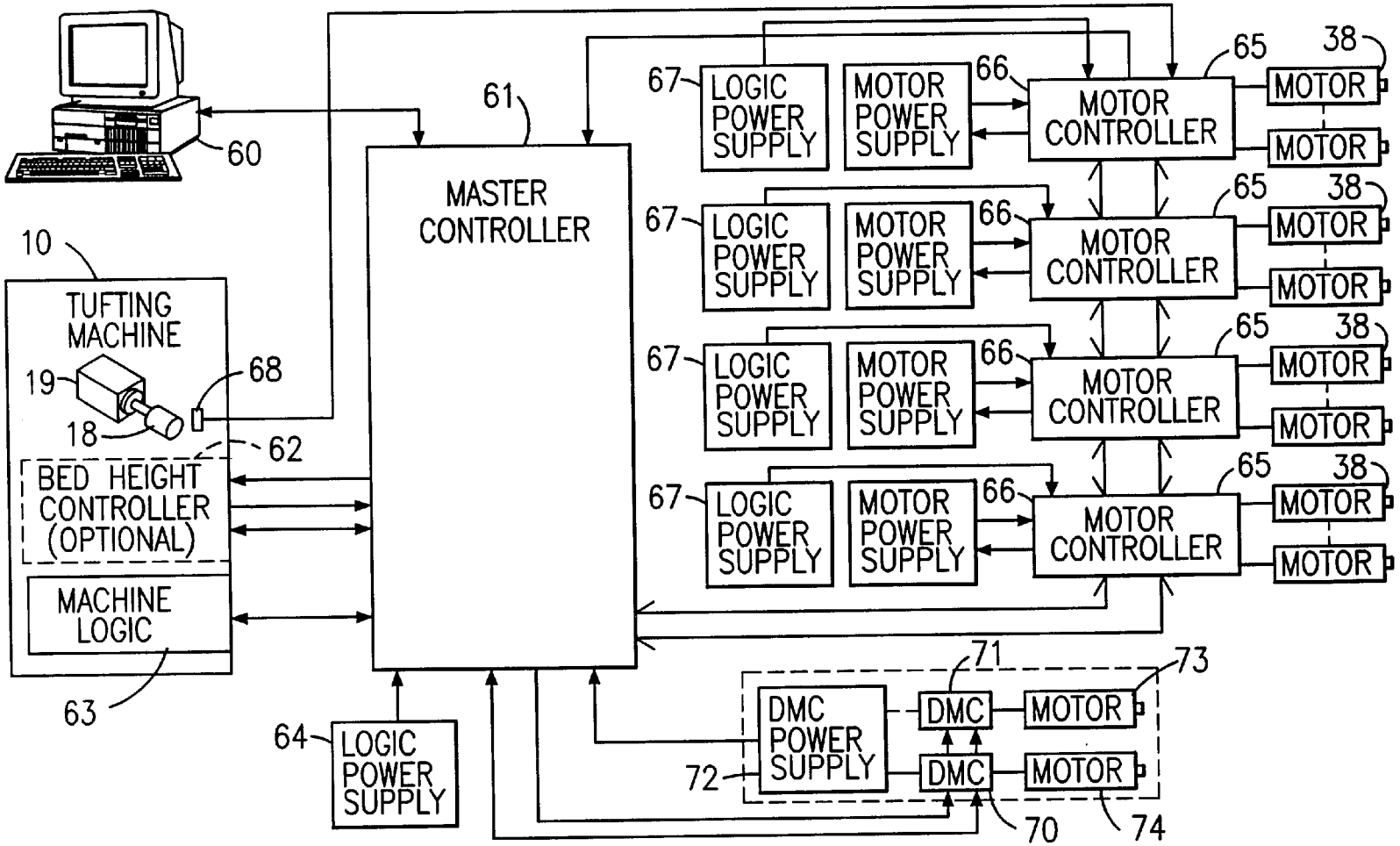
FIG. 6 is a schematic view of the electrical flow diagram for a multiple needle tufting machine incorporating a yarn feed mechanism made in accordance with the invention.

A main drive motor 16, schematically shown in FIG. 6, drives a rotary main drive shaft 17 mounted in the head 18 of the tufting machine. Drive shaft 17 in turn causes push rods 19 to move reciprocally toward and away from the base fabric. This causes needle bar 20 to move in a similar fashion. Needle bar 20 supports a plurality of preferably uniformly spaced needles 21 aligned transversely to the fabric feed direction 14. The needle bar 20 may be shiftable by means of well known pattern control mechanisms, not shown, such as Morgante, U.S. Pat. No. 4,829,917, or R. T. Card, U.S. Pat. No. 4,366,761. It is also possible to utilize two needle bars in the tufting machine, or to utilize a single needle bar with two, preferably staggered, rows of needles.

In operation, yarns 22 are fed through tension bars 23, into the pattern control yarn feed device 11. Then yarns 22 are guided in a conventional manner through yarn puller rollers 24, and yarn guides 25 to needles 21. A looper mechanism, not shown, in the base 15 of the machine 10 acts in synchronized cooperation with the needles 21 to seize loops of yarn 22 and form cut or loop pile tufts, or both, on the bottom surface of the base fabric in well known fashions.

In order to form a variety of yarn pile heights, a pattern controlled yarn feed mechanism 11 incorporating a plurality of yarn feed rolls adapted to be independently driven at different speeds has been designed for attachment between the tensioning bars 23 and the yarn puller rollers 24.

Figure 1B:
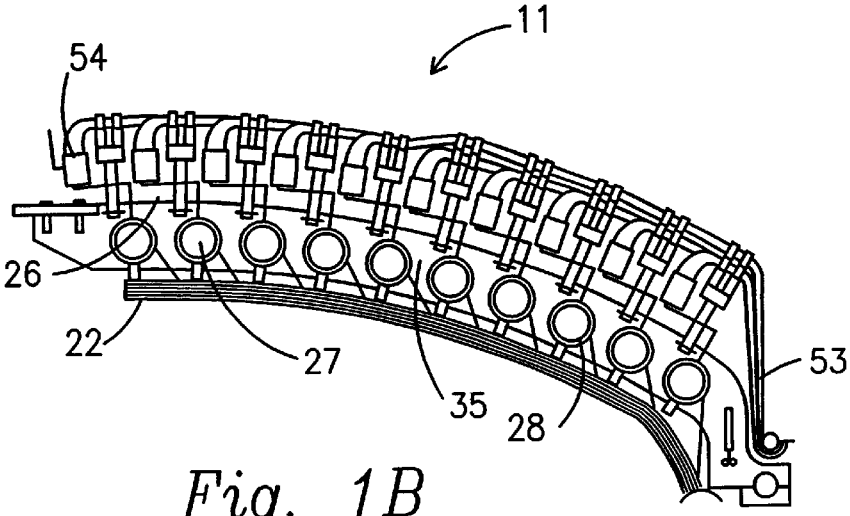
FIG. 1B is a side elevation view of an alternative embodiment of an arched support for a pattern control yarn feed mechanism according to the invention, shown in isolation.
Figure 2:
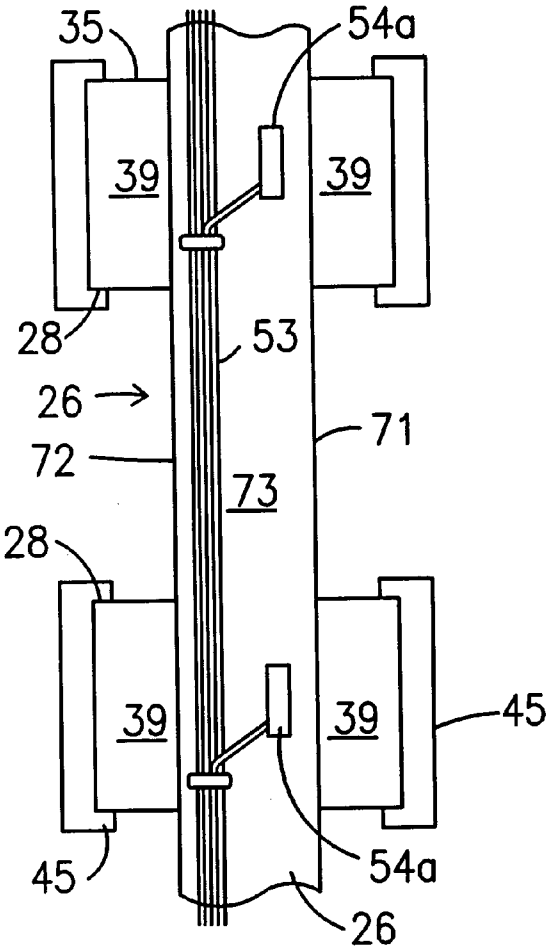
FIG. 2 is a top elevation view of a segment of an arched mounting bar with four single end servo driven yarn feed rolls, two on each side.

As best disclosed in FIGS. 1A and 1B, a yarn drive array is assembled on an arching support bar 26 extending across the front of the tufting machine 10 and providing opposing vertical mounting surfaces 71, 72 on each of its sides and an upward facing top surface 73 (shown in FIG. 2). On the opposing side-facing surfaces 71, 72 are mounted a total of 20 single end servo driven yarn feed rolls 28, ten on each side, shown in isolation in FIGS. 2–5. It will be understood that the number of rolls on each support bar 26 may be varied for many reasons, especially in proportion to the gauge of the needles 21 on the needle bar 20. For instance, in the case of 1/8 gauge needle spacing (8 needles per inch) and support bars spaced every three inches, it would be desirable to carry 24 independently driven yarn feed rolls on each support bar 26. In practice, the support bars 26 should carry at least about 6, and preferably at least about 12, single end servo driven yarn feed rolls 28.

Figure 3B:
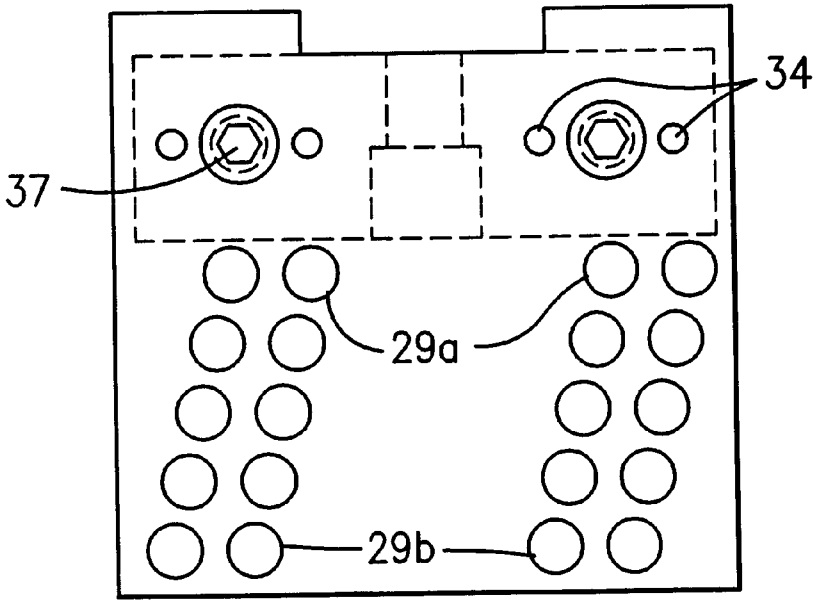
FIG. 3B is an alternative yarn guide plate.
Figure 3A:
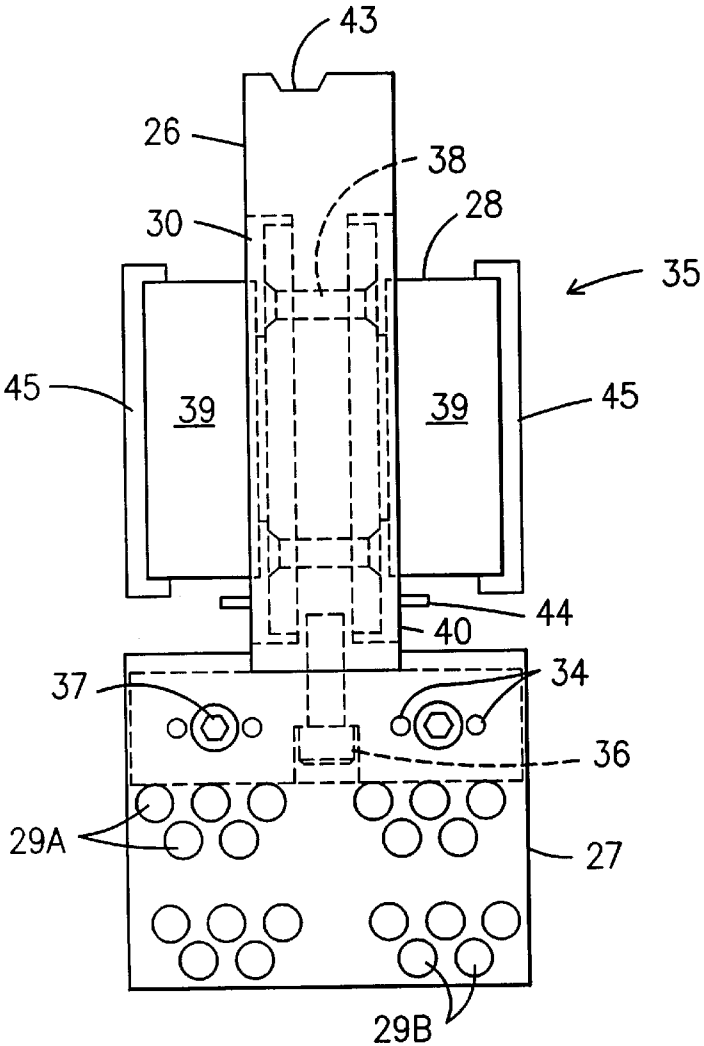
FIG. 3A is a rear elevation view of an arching support holding two yarn feed rolls, two servo motors that control yarn feed roll rotation, and yarn guide plate.

As shown in FIG. 1A and in detail in FIG. 2, the arching support bar 26 accommodates the wiring bundle 53 from the motors via the wiring path 43, shown in FIG. 3A, built into the arching support bar 26, which facilitates the wiring of the motors. Wiring plugs 54*a* and 54*b* join the wiring bundle 53 to leads connected to the motors 31 and allow for easy servicing. Wiring bundle 53 is in turn connected to servo motor controller board 65 which may be in a central cabinet or installed on an arching support 26. This latter wiring configuration minimizes the wire length from the controller board 65 to the motor 31, thereby reducing tangling, wire damage due to excessive length, and electrical shorting. Troubleshooting electrical problems is also improved by this wiring configuration and shorter overall wire length.

Figure 4:
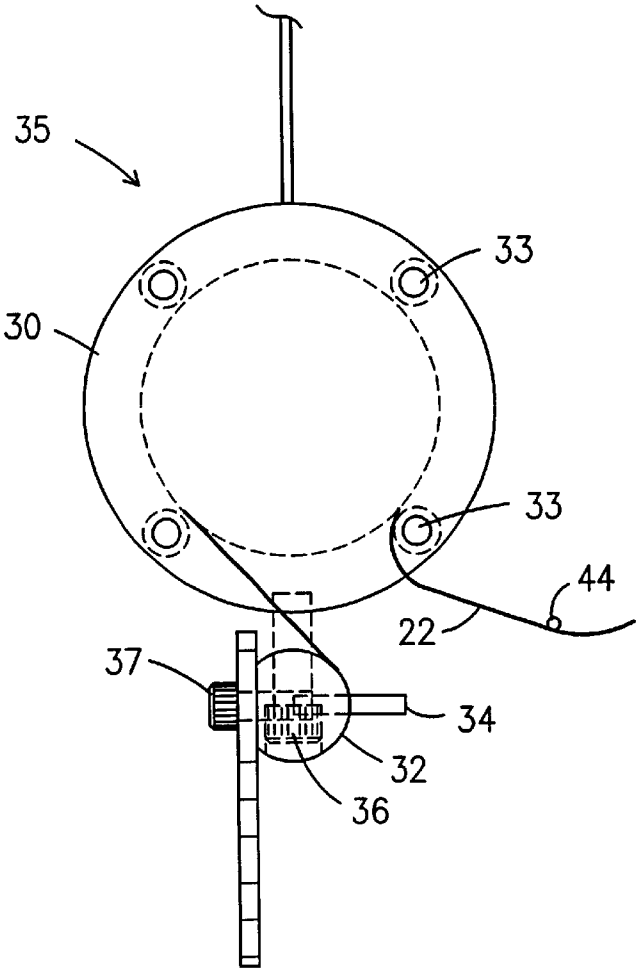
FIG. 4 is a side elevation view of a yarn drive and the yarn guide plate of FIG. 3A.
Figure 5:
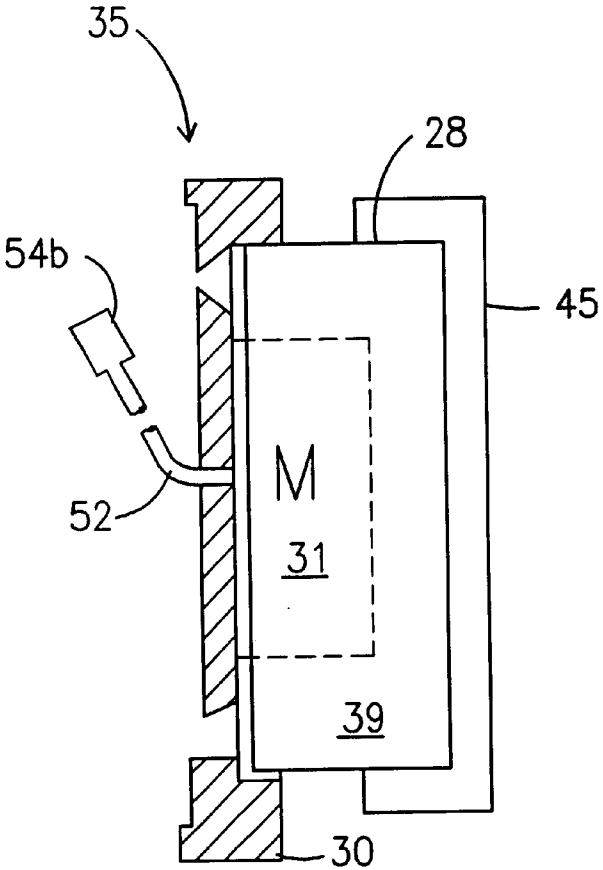
FIG. 5 is a rear partial sectional view of a servo motor with feed roll.

Each single end yarn drive 35 consists of a yarn feed roll 28 and a servo motor 31, shown in isolation on FIG. 5. The servo motor 31 directly drives the yarn feed roll 28, which may be advantageously attached concentrically about the servo motor 31. A tension roll 32 shown in FIG. 4, controls the feed and wrapping of the yarn onto the yarn feed roll 28 to insure there is adequate traction of yarn 22 with roll 28. The yarn 22 is guided onto the tension roll 32 by the yarn guide plate 27. The position of the yarn guide plate 27 and the tension roll 32 is fixed with fastening screw 36. Preferably a yarn 22 is angled so that is wrapped around nearly 180° of the circumference of the yarn feed roll 28, and at least about 135° of said circumference. Yarn guide posts 34 protrude from the rear of yarn guide plates 27 and help ensure the proper placement of yarn 22 on yarn feed rolls 28.

It will also be noted in FIGS. 1A and 3A that yarns from the yarn supply are fed through upper 29*a* and lower 29*b* apertures on the support yarn guides 27. Specifically, a yarn 22 for a yarn feed drive 35 on the support distal from the tufting machine is fed through upper apertures 29*a* until it reaches its associated yarn drive, is fed around approximately 180° of the yarn feed roll 28 on its associated yarn drive 35, and continues through upper apertures 29*a* of the support yarn guides 27 until the midpoint of the support 26 is reached. At this point, the yarns 22 for the distal yarn feed drives 35 are threaded through lower apertures 29*b* in the remaining proximal yarn guides 27. Conversely, yarns for proximal yarn drives come from the yarn supply through lower apertures 29*b* in the distal yarn guides 27 until about the middle of the yarn drives and the support 26 when those yarns 22 are directed to the upper apertures 29*a* in the proximal yarn guides and cross the yarns from the distal yarn drives. In this fashion, the crossing of yarns occurs substantially at one point 37, opportunities for yarn friction and breakage minimized, and yarn threading simplified.

In a preferred embodiment depicted in FIGS. 1B and 3B, it is not necessary to cross the yarns, the offset position upper apertures 29*a* from lower apertures 29*b* in the yarn guide plate 27 begin sufficient to permit yarns to continue through the same aperture position and around their designated yarn feed rolls 28 without significant friction between yarns 22.

Figure 1C:
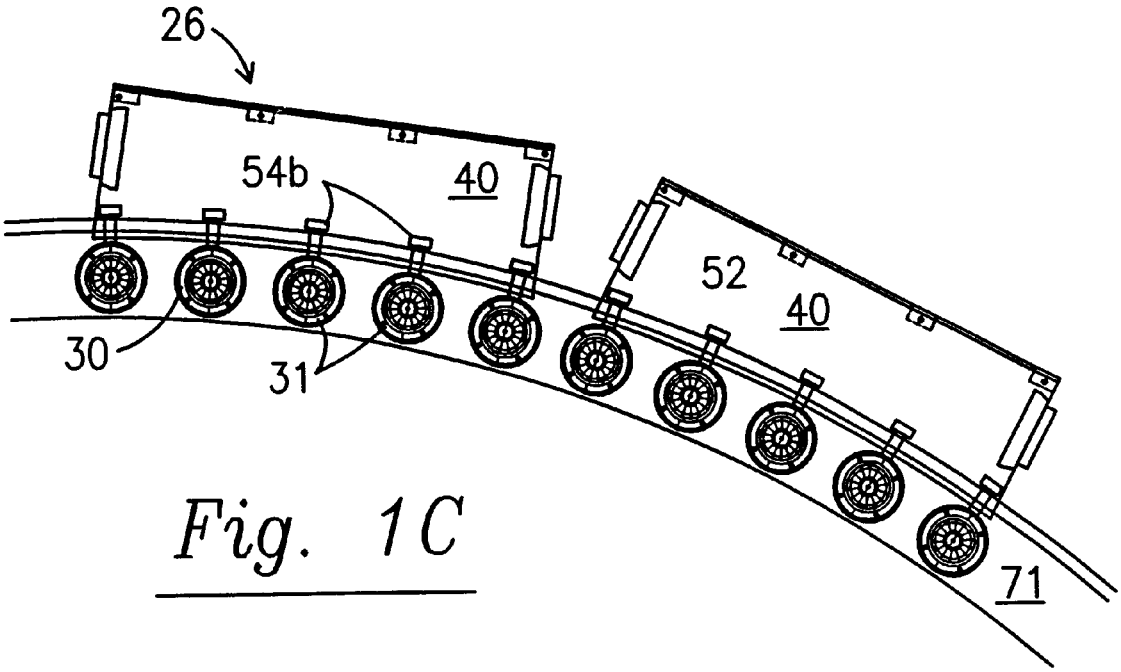
FIG. 1C is a side elevation view of a partially assembled embodiment of an arched support for a pattern control yarn feed mechanism according to the invention, showing the motor and wiring positions.
Figure 1D:
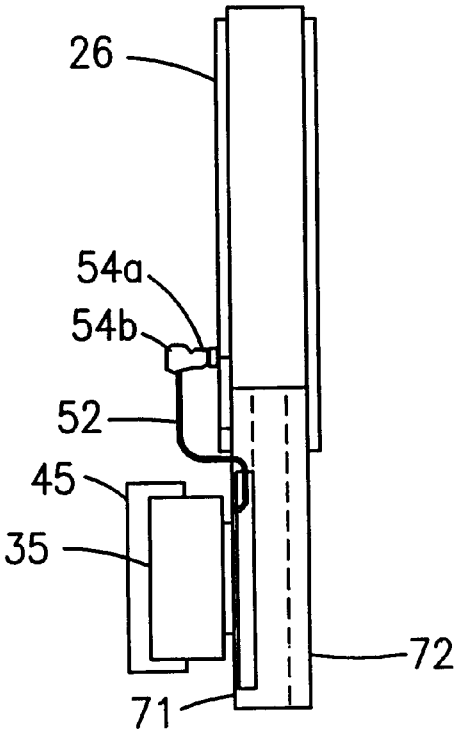
FIG. 1D is a rear sectional view of the support of FIG. 1C.

FIGS. 1C and 1D feature the preferred wiring of arched supports 26 showing motors 31 or yarn feed drives 35 only on one vertical side 71 of the support 26. The electrical connections 52 from motors 31 end in plugs 54*b* which mate with plugs 54*a* set in cover plates 40. Cover plates 40 are removably secured to arched support 26 and conceal individual servo motor controllers 69.

Figure 8:
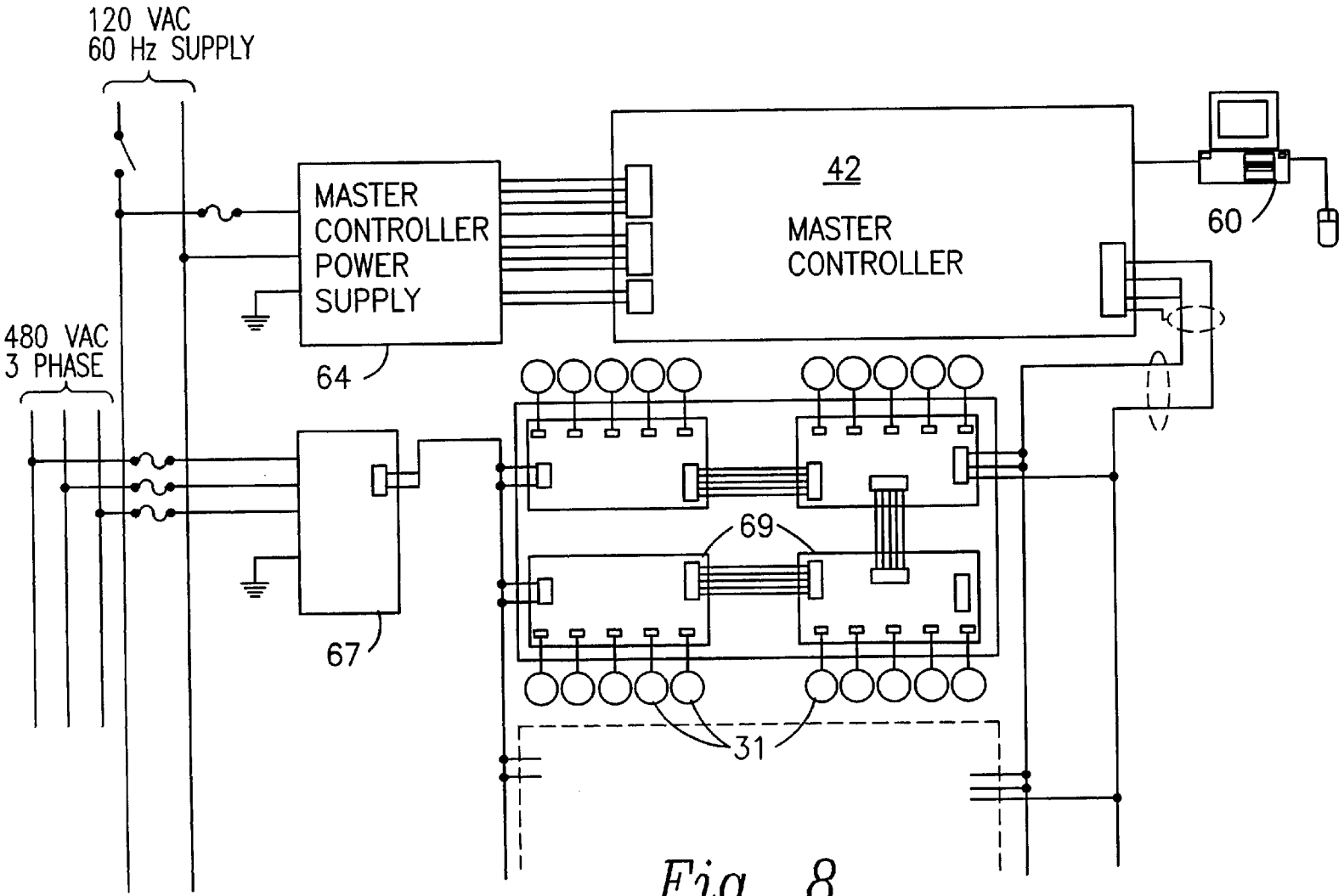
FIG. 8 is a schematic view of the electrical flow diagram for a single arched support carrying twenty servo motors.

As shown in FIG. 8, the invention is currently wired with four individual servo motor controllers 69, each controlling five motors 31. Collectively the four individual servo motor controllers comprise the servo motor controller board 65. It will be appreciated that the controllers 69 may be dispersed under separate cover plates 40 or collectively mounted on a single board 69 under a single cover plate 40, or even placed in a central controller cabinet depending upon wiring considerations. The wiring of Figures 1C and 8 is presently preferred. It will also be understood that more powerful controllers 69 might operate more than five motors 31 or in some instances fewer or even a single motor 31 might be operated by a controller 69. The most desirable wiring for a given application will depend upon the speed and price of available controllers as well as the speed at which the yarn feed attachment is intended to operate.

It will also be seen in FIGS. 4 and 5 that the servo motors 31 are set on base plates 30 of greater diameter than the yarn feed rolls 28 and are mounted onto the arching support bar 26 using four motor mount bolts 38 through mounting holes 33 in the base plates.

Each feed roll 28 has a yarn feeding surface 39 formed of a sand-paper like or other high friction material upon which the yarns are fed. Each of these yarn feed rolls 28 may be loaded with one yarn, which is a light load providing little resistance compared to the hundred or more yarns that might be carried on a roll-type yarn feed attachment, the hundreds of individual yarns typically driven by a single scroll drive shaft, or even the dozen yarns typically driven in co-pending Ser. No. 08/980,045. Because of the lighter loads used, this design permits the use of small servo motors that can mount inside or outside of the yarn feed rolls 28. For instance, a typical motor for driving a single end of yarn would be a 24–28 volt motor using 3 amps of power. This motor would be able to generate 5 lb-in of torque at 3 amps, having a maximum no load speed of 650 RPM. A representative motor of this type is the Full Repeat Scroll Motor by Moog, Inc. (C22944), which meets these general specifications. A motor of this type is sufficiently powerful to turn the associated yarn feed roll without the need for any gearing advantage. Thus the preferred ratio of servo motor revolutions to yarn feed roll revolutions is 1:1.

Turning now to FIG. 6, a general electrical diagram of the invention is shown in the context of a computerized tufting machine. A personal computer 60 is provided as a user interface, and this computer 60 may also be used to create, modify, display and install patterns in the tufting machine 10 by communication with the tufting machine master controller 42.

Due to the very complex patterns that can be tufted when individually controlling each end of yarn, many patterns will comprise large data files that are advantageously loaded to the master controller by a network connection 41; and preferably a high bandwidth network connection. For instance, digital representations of complex scroll patterns for traditional scroll pattern attachments might be stored in about 2 Kb of digital memory. A digital representation of a pattern for the single end servo driver scroll of the present invention might not repeat for 10,000 stitches and could require 20 Gb of disk space before data compression and about 20 Mb even after compression.

Master controller 42 in turn preferably interfaces with machine logic 63, so that various operational interlocks will be activated if, for instance, the controller 42 is signaled that the tufting machine 10 is turned off, or if the "jog" button is depressed to incrementally move the needle bar, or a housing panel is open, or the like. Master controller 42 may also interface with a bed height controller 62 on the tufting machine to automatically effect changes in the bed height when patterns are changed. Master controller 42 also receives information from encoder 68 relative to the position of the main drive shaft 17 and preferably sends pattern commands to and receives status information from controllers 46, 47 for backing tension motor 48 and backing feed motor 49 respectively. Said motors 48, 49 are powered by power supply 50. Finally, master controller 42, for the purposes of the present invention, sends ratiometric pattern information to the servo motor controller boards 65. The master controller 42 will signal a particular servo motor controller board 65 that it needs to spin its particular servo motors 31 at given revolutions for the next revolution of the main drive shaft 17 in order to control the pattern design. The servo motors 31 in turn provide positional control information to their servo motor controller board 65 thus allowing two-way processing of positional information.

Power supplies 67, 66 are associated with each servo motor controller board 65 and motor 31.

Master controller 42 also receives information relative to the position of the main drive shaft 17. Servo motor controller boards 65 process the ratiometric information and main drive shaft positional information from master controller 42 to direct servo motors 31 to rotate yarn feed rolls 28 the distance required to feed the appropriate yarn amount for each stitch.

In commercial operation, it is anticipated that a typical broadloom tufting machine will utilize pattern controlled yarn feed devices 11 according to the present invention with 53 support bars 26, each bearing 20 yarn feed drives 35 thereby providing 1060 independently controlled yarn feed rolls 28. If any yarn feed roll 28 or associated servo motor 31 should become damaged or malfunction, the arched support bar 26 can be pivoted downward for ease of access. A replacement single end yarn drive 35 already fitted with a yarn feed roll 28 and a servo motor 31 can be quickly installed. This allows the tufting machine to resume operation while repairs to the damaged or malfunctioning yarn feed rolls and motor are completed, thereby minimizing machine down time.

The present feed attachment 11 provides substantially improved results by providing scroll type yarn control while eliminating the need for a tube bank. Historically, tube banks have been designed in three ways: to minimize tube length, to minimize differences in yarn drag through the tubes, and to compromise between these two alternatives. All tube bank designs entail significant expense and introduce undesirable yarn drag into tufting operations.

The present design, unlike the previous art, does not use tube banks to distribute the yarns 22 to the needle bar 20. Instead the yarns 22 are directly routed to the needle bars 20 through the yarn guides 25. This is possible because yarns can be individually driven by feed rolls in directional alignment with the respective needles. By eliminating the tube banks, the source of friction variations is removed, eliminating the need for control schemes to correct for this problem.

Another significant advance permitted by the present pattern control attachment 11 is to permit the exact lengths of selected yarns to be fed to the needles. Unlike the previous art, each yarn may be controlled individually to produce the smoothest possible finish. For instance, in a given stitch in a high/low pattern on a tufting machine that is not shifting its needle bar the following situations may exist:

1. Previous stitch was a low stitch, next stitch is a low stitch.
2. Previous stitch was a low stitch, next stitch is a high stitch.
3. Previous stitch was a high stitch, next stitch is a high stitch.
4. Previous stitch was a high stitch, next stitch is a low stitch.

Obviously, with needle bar shifting which requires extra yarn depending upon the length of the shift, or with more than two heights of stitches, many more possibilities may exist. In this limited example, it is preferable to feed the standard low stitch length in the first situation, to slightly overfeed for a high stitch in the second situation, to feed the standard high stitch length in the third situation, and to slightly underfeed the low stitch length in the fourth case. On a traditional scroll type attachment, the electromagnetic clutches can engage either a high speed shaft for a high stitch or a low speed shaft for a low stitch. Accordingly, the traditional scroll type attachment cannot optimally feed yarn amounts for complex patterns which results in a less even finish to the resulting carpet. The independence obtained by the single end servo scroll would allow for these minor changes on a per yarn basis, enabling pattern capabilities that were not possible before.

In a typical configuration, the single end yarn drives would be spaced at about four to seven inch intervals along the support bar. This spacing is necessary to ensure proper yarn travel and minimal yarn resistance and stretching while still allowing for enough space between the yarn feed rolls 28 to allow minor adjustments. The distance between support brackets is typically 3¼ inches but may vary in either direction. This variability is necessary because of variations in the needle gauge that may be used. For instance, a larger needle gauge will require the needles be spread at further intervals allowing more space between the support arms. However, for the smaller needle gauge, the support arms will need to be closer together due to the increased proximity of the needles.

Figure 7:
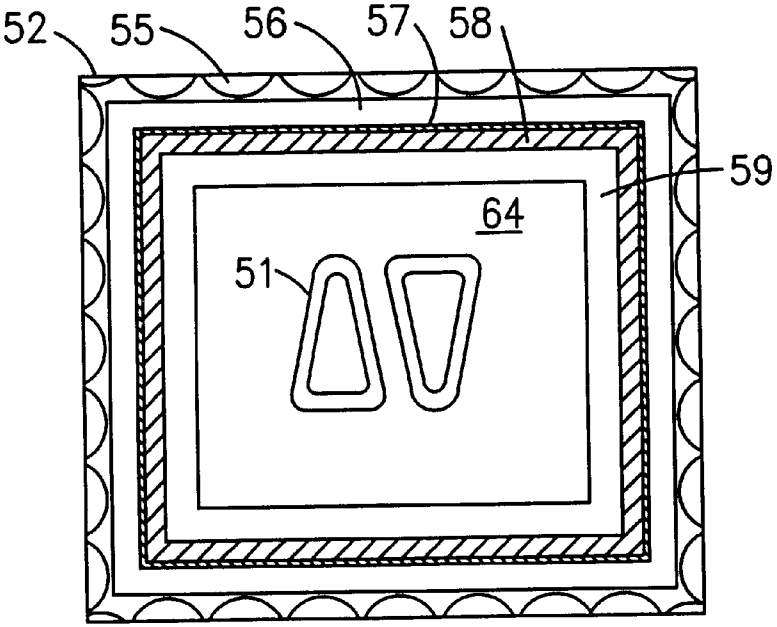
FIG. 7 is a carpet design with a series of concentric borders made possible by use of the invention.

There are several advantages to having independently controlled single end yarn drives, particularly with regards to the patterns that can be created. By having each end of yarn independently controlled by its own dedicated yarn drive, this pattern device can produce designs that are not possible using previous broad loom tufting machines. For instance, a non-continuous repeating pattern may be made across the width of the tufting machine, utilizing three or more yarn heights for each yarn. This pattern could consist of any design such as a word message or non-repeating geometric design across the entire carpet in various colors. Another design type that this type of pattern device may create is a rug with central design surrounded by a border. For example, a rug with a word phrase surrounded in the center by one color, then surrounded by a border of another color could easily be produced with this device without special consideration. A rug 52 with a series of centric borders, 55, 56, 57, 58, 59, 61, as shown in FIG. 7 may also be tufted. Each yarn in rug 52 is tufted through a backing fabric so that a series of back stitches are on the bottom of finished rug while the tufted bights form cut or loop pile stitches on the top or face of the finished rug. The yarns in each border may be tufted at three or more lengths to precisely control the yarns for color transitions or sculptured effects.

Although the illustrated borders are shown in two colors, the border patterns could also be created in a high/low textured or sculpted manner from a single color of yarn. Typically the borders, 55, 56, 57, 58, 59, 61, will surround a central area 64. The central area 64 may or may not be textured or contain a design 52.

A second type of design possible with this pattern attachment is one that involves the creation of color picture designs that are facimiles of digital images. By loading a front pattern device with A and B yarns fed to a front needle bar and loading a rear pattern device with C and D yarns fed to a rear needle bar, full color pictures may be created from the yarns. Typically, the A, B, C, and D yarns will consist of shades of red, yellow, and green or red, yellow, and blue, combined with another color for aid in light and dark shading. Many other combinations of colored yarns may be used to achieve varied results.

In the preferred embodiment, a color image is digitally input into a computer using a scanner, as typified by Hewlett Packard ScanJet 5100c or other digital device. The digital image is processed by the computer, which calculates the correct yarn color mixes and corresponding yarn heights to produce the desired spectral effect. The yarn height information is translated into rotational instructions for each yarn drive. Using this information, an approximation of the digital image can be recreated within the yarns of a carpet.

The prior art for the creation of carpet of individually tufted yarns is typified by U.S. Pat. No. 4,549,496 where a pneumatic system is used to direct each strand of yarn in the pattern control device. This process has significant limitations involving size of rugs it can produce and the production speed due to the complexity of directing the various colored yarns using pneumatic technology, and the limited number of needles sewing each stitch. With the single end servo scroll pattern attachment described, broad loom carpets with complex color pictures are created with greater efficiency and speed.

While preferred embodiments of the invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those skilled in the art that the present invention is not limited thereto since many modifications can be made. Therefore, it is contemplated that any and all such embodiments are included in the present invention as may fall within the scope or equivalent scope of the appended claims.

We claim:

1. In a multiple needle tufting machine adapted to feed a backing fabric longitudinally from front to rear through the machine having a plurality of spaced needles aligned transversely of the machine for reciprocable movement through the backing fabric by operation of a rotary main drive shift, a yarn feed mechanism comprising:

(a) a support having a mounting surface;

(b) a plurality of servo motor driven single end yarn drives removably attached to said mounting surface;

(c) a servo motor controller for processing ratiometric information, electronically connected to a servo motor of a single end yarn drive;

(d) a master controller which receives rotational position information for the main drive shaft and sends corresponding ratiometric pattern information by electrical connection to the servo motor controller board.

2. The yarn feed mechanism of claim 1 wherein at least about 6 single end yarn drives are attached to said support bar.

3. The yarn feed mechanism of claim 2 wherein said yarn feed mechanism comprises approximately 20 single end yarn drives attached to said support bar.

4. The yarn feed mechanism of claim 1 wherein the support is arched and extends longitudinally away from the tufting machine.

5. The yarn feed mechanism of claim 1 wherein at least about 20 support bars are aligned transversely on the tufting machine and extend longitudinally away from the tufting machine.

6. The yarn feed mechanism of claim 1 wherein said single end yarn drives can be rotated at any one of at least sixteen speeds by said associated servo motor.

7. The yarn feed mechanism of claim 1 wherein the servo motors of said single end yarn drives operate with less than ten pounds per inch of torque.

8. The yarn feed mechanism of claim 1 wherein the servo motors associated with said single end yarn drives are mechanically connected to yarn feed rolls on said single end yarn drives such that the rotations of the servo motors correspond to the rotations of the yarn feed rolls with a 1:1 ratio.

9. The yarn feed mechanism of claim 1 wherein the single end yarn feed drive comprises a yarn feed roll concentrically placed about and mechanically connected to the servo motor.

10. The yarn feed mechanism of claim 1 wherein a computer is used to communicate pattern information to the master controller.

11. The yarn feed mechanism of claim 1 wherein a computer network is used to communicate pattern information to the master controller.

12. The yarn feed mechanism of claim 1 wherein said servo motor associated with said single end yarn drive provides positional control information to the electronically connected servo motor controller board.

13. A method of automatically inputting the parameters of tufting into a tufting machine of the type having an electronically controlled yarn feed attachment for providing measured increments of yarn to a plurality of transversely aligned needles adapted to be reciprocably driven, through a backing fabric passing from front to back through the tufting machine by a rotary main drive shaft, thereby placing stitches comprising tufts of yarn through said backing fabric comprising the steps of:

(a) inputting pattern parameters of width, length, color, a relatively high pile height and a relatively low pile length, for stitches on a computer display wherein the width of the pattern is limited only by the number of transversely aligned needles of the tufting machine;

(b) designing a pattern showing the location of relatively high pile tufts and relatively low pile tufts on the computer display to create a graphic representation of tufted carpet in a data file;

(c) processing the data file containing the graphic representation of tufted carpet to assign yarn feed values to stitches based upon the pile height selected for that stitch and at least the preceding stitch.

14. The method of claim 13 wherein the graphic representation created in the pattern design step (b) comprises the input of a digital image.

15. The method of claim 13 wherein the assignment of yarn feed values to stitches is based upon the pile height selected for that stitch and at least the previous stitch.

16. The method of claim 13 wherein the yarn feed value assigned to a relatively high pile tuft coming after a relatively high pile tuft and a relatively low pile tuft is greater than the yarn feed value assigned to a relatively high pile tuft coming after two relatively high pile tufts.

17. The method of claim 13 wherein individually colored yarn ends are combined to produce a spectrum of colors by:

(a) configuring a tufting machine having two rows of transversely aligned needles with front and rear single end servo scroll pattern attachments;

(b) loading the front single end yarn drives with alternating yarns of first and second colors;

(c) loading the rear single end yarn drives with alternating yarns of third and fourth colors;

(d) inputting the color information of each loaded yarn end on the single end yarn drives into a computer;

(e) blending the yarns to approximate predetermined colors using computer logic to adjust the yarn feed values.

18. The method of claim 17 wherein the predetermined colors are selected from a digital image.

19. The method of claim 13 wherein the tufting machine is of the type having at least one shiftable needle bar and the assignment of yarn feed values to stitches in step (c) is additionally based upon the distance said at least one needle bar is shifted for that stitch.

20. The method of claim 19 wherein the assignment of yarn feed values to stitches in step (c) is additionally based upon the distance said at least one needle bar is shifted in the preceding stitch.

21. The method of claim 19 wherein the assignment of yarn feed values to stitches in step (c) is additionally based upon the distance said at least one needle bar is shifted in the following stitch.

* * * * *